US009485845B2

(12) United States Patent
Fregoso et al.

(10) Patent No.: US 9,485,845 B2
(45) Date of Patent: Nov. 1, 2016

(54) ELECTRICAL DISCHARGE LIGHTING

(71) Applicant: Lux Montana LLC, Missoula, MT (US)

(72) Inventors: Gilbert Fregoso, Fallbrook, CA (US); Yuval Charles Avniel, Missoula, MT (US)

(73) Assignee: Lux Montana LLC, Missoula, MT (US)

( * ) Notice: Subject to any disclaimer, the term of this patent is extended or adjusted under 35 U.S.C. 154(b) by 550 days.

(21) Appl. No.: 13/801,316

(22) Filed: Mar. 13, 2013

(65) Prior Publication Data

US 2014/0265834 A1 Sep. 18, 2014

(51) Int. Cl.
*H05B 41/38* (2006.01)

(52) U.S. Cl.
CPC ..... *H05B 41/382* (2013.01)

(58) Field of Classification Search
USPC ..... 315/40, 43, 51, 59, 63; 313/552, 607, 313/631, 634, 637
See application file for complete search history.

(56) References Cited

U.S. PATENT DOCUMENTS

| | | | | |
|---|---|---|---|---|
| 6,734,643 | B2 * | 5/2004 | Okamoto et al. | 315/336 |
| 8,022,644 | B2 * | 9/2011 | Deppe et al. | 315/326 |
| 2003/0141797 | A1 | 7/2003 | Isida et al. | |
| 2003/0141826 | A1 | 7/2003 | Zhu et al. | |
| 2007/0114942 | A1 | 5/2007 | Dekkers et al. | |
| 2007/0200504 | A1 | 8/2007 | Brinkhoff et al. | |
| 2010/0181910 | A1 * | 7/2010 | Kessels | 313/594 |
| 2010/0264819 | A1 * | 10/2010 | Chen et al. | 313/607 |
| 2011/0298365 | A1 * | 12/2011 | Boroczki et al. | 313/623 |

OTHER PUBLICATIONS

International Search Report of the International Search Authority (KR) dated Aug. 21, 2014 for International Application No. PCT/US2014/026695, 3 pgs.

* cited by examiner

*Primary Examiner* — Thai Pham
(74) *Attorney, Agent, or Firm* — Hunter Clark PLLC

(57) ABSTRACT

An electrical discharge lighting apparatus includes: a bulb including a chamber section comprising transparent material and containing a gas that is responsive to electric current to emit light; an ionizing conductor configured and disposed to provide a voltage across the gas to ionize and break down the gas; and an electrode physically separate from the ionizing conductor and configured and disposed to induce a current through the gas.

27 Claims, 9 Drawing Sheets

ELECTRICAL DISCHARGE LIGHTING

BACKGROUND

The uses and need for artificial lighting have expanded since the time of the first incandescent light bulb. Incandescent light bulbs use significant amounts of power, and lose significant amounts of power to heat instead of light. Incandescent lights have recently been giving way to newer technologies such as compact fluorescent lights (CFLs), light-emitting diodes (LEDs), and high-intensity discharge (HID) lights. These different technologies for generating light have yielded more power efficiency, and improvements in materials have increased lifetime of bulbs using some of these technologies. The lights, however, sometimes have undesired characteristics such as the use of mercury (in CFLs), undesirable light color, dim output, high cost, unsatisfactory lifetime, and/or inability to light quickly and/or re-light soon after being turned off.

SUMMARY

An example electrical discharge lighting apparatus includes: a bulb including a chamber section comprising transparent material and containing a gas that is responsive to electric current to emit light; an ionizing conductor configured and disposed to provide a voltage across the gas to ionize and break down the gas; and an electrode physically separate from the ionizing conductor and configured and disposed to induce a current through the gas.

Implementations of such an apparatus may include one or more of the following features. The electrode is physically isolated from the gas and at least one of capacitively or inductively coupled to the gas to induce the current through the gas. The electrode is disposed outside the bulb. The electrode is disposed at least partially within a material forming the bulb or is at least partially part of the bulb. The electrode is a first electrode and the apparatus further includes at least a second electrode. The bulb comprises a tubular receptacle that receives the ionizing conductor and a chamber section, where the first electrode is disposed over a portion of the receptacle and a first portion of the chamber section, and the second electrode is disposed over a second portion of the chamber section displaced from the first portion of the chamber section. The chamber section is substantially spherical. The first electrode has a first configuration and the second electrode has a second configuration that is different from the first configuration.

Also or alternatively, implementations of the apparatus may include one or more of the following features. The ionizing conductor is disposed inside the bulb. The ionizing conductor is disposed in physical contact with the gas. The ionizing conductor is configured to provide the voltage in conjunction with at least one of the electrodes. The ionizing conductor comprises a first ionizing conductor and the apparatus further includes a second ionizing conductor, where the first ionizing conductor is configured to provide the voltage in conjunction with the second ionizing conductor. The first ionizing conductor and the second ionizing conductor comprise all the ionizing conductors of the apparatus, the electrode is a first electrode and the apparatus further comprises a second electrode, and the electrode and the second electrode comprise all the electrodes of the apparatus. The first ionizing conductor is collinear with the second ionizing conductor. The bulb comprises a first receptacle receiving the first ionizing conductor and a second receptacle receiving the second ionizing conductor, and wherein the first receptacle is disposed parallel to the second receptacle.

Also or alternatively, implementations of the apparatus may include one or more of the following features. The apparatus further includes a power supply configured to receive power from a power source and to provide, in parallel, drive power to the electrode and a strike voltage to the ionizing conductor. The power supply comprises solid-state circuitry. The apparatus further includes an ionizer module coupled to the ionizing conductor and configured to: receive a strike voltage; provide the strike voltage to the ionizing conductor; and isolate the strike voltage from the ionizing conductor in response to the ionizing conductor conducting a current in excess of a current threshold. The bulb comprises a receptacle receiving the ionizing conductor, the receptacle being connected to the chamber section, wherein the chamber section defines a chamber containing the gas, and wherein the ionizing conductor extends into the chamber less than 10% of a distance across the chamber.

An example electrical discharge system includes: a lamp including a bulb; drive means for providing a strike voltage and a drive voltage in parallel; strike means, electrically coupled to the drive means, for striking the lamp by receiving and providing the strike voltage to a light-emitting gas of the lamp; and run means, electrically coupled to the drive means, for running the lamp by receiving and providing the drive voltage to the gas of the lamp.

Implementations of such a system may include one or more of the following features. The strike means comprise an ionizer disposed inside the bulb and wherein the run means comprise an electrode physically separated from a gas contained inside the bulb. The strike means comprise multiple ionizers disposed inside the bulb and the run means comprise multiple electrodes disposed outside the bulb. The strike means comprise an ionizer and the run means are further for responding to the strike means conducting current in excess of a threshold current by isolating the strike voltage from the ionizer. The run means comprise multiple electrodes with at least one of the plurality of electrodes disposed at least partially inside the bulb. The run means comprise multiple electrodes with at least one of the plurality of electrodes at least partially comprising part of the bulb.

An example method of operating an electric-discharge lamp, that includes a bulb, includes: providing a first voltage to a first set of conductive members disposed inside the bulb to ionize a gas inside the bulb; providing a second voltage to a second set of conductive members at least partially disposed outside the bulb to at least one of capacitively or inductively induce a current in the gas in response to the gas breaking down; and discontinuing to provide the first voltage to the first set of conductive members in response to the gas breaking down.

Items and/or techniques described herein may provide one or more of the following capabilities, as well as other capabilities not mentioned. Light may be provided more energy efficiently than with prior lamps. Lamps may operate with low losses and/or may provide more lumens per watt, e.g., 140 lumens per watt, than prior lamps. Lamps may be provided that are more environmentally friendly (e.g., being made of non-hazardous materials), are more cost effective to produce and/or operate, are amenable to alternating-current or direct-current drive systems, are less costly to produce and/or maintain, produce little heat, may be operated without a separate or external ballast, may have a variety of shapes and/or sizes, may be easily integrated into solid-state networks, have fast strike and re-strike characteristics, may be dimmable, and/or may produce a variety of light types (e.g., ultraviolet light (e.g., for water purification), red light, blue light, etc.). Lamps may be provided that have less light degradation over time, less material degradation over time, longer lifetimes, lower maintenance cost, and/or less heat production than prior lamps. Lamps may be provided with a wide variety of physical shapes, both large and small. Lamps can be made using common materials, and without use of hazardous materials such as mercury. Lamps are provided that may be powered by alternating-current power and/or direct-current power. Lamps may be provided with various color rendering indexes, e.g., between 80 and 97 or even higher. Conductive element splatter in an electrical discharge lamp can be reduced or eliminated. An electrical discharge light can be started quickly and restarted immediately or nearly immediately after being shut off. Lamps can be produced using automated, high-speed and/or mass production techniques. Lamps can operate over a wide range of temperatures, e.g., from about −50° C. to about 150° C. Lamps can operate while emitting low amounts of electromagnetic radiation including radio frequency radiation. Driving a lamp with solid-state circuitry can help reduce electromagnetic interference and help avoid the use of an external or separate ballast. Performance and/or lifetime of electrodes for running lamps can be improved. Performance and/or lifetime of electrodes for running lamps can be affected with no degradation due to plasma or operating gases. Working electrodes may be separated from working gas (plasma) so that there is no contact between the working gas and the working electrodes, e.g., enabling the use of gas systems that are presently unavailable and/or impractical. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect. Lamps may be easily integrated into smart systems.

DETAILED DESCRIPTION

Techniques are provided for electrical discharge lighting. For example, an electrical discharge system includes a lamp that has separate mechanisms for starting the lamp and running the lamp. The lamp contains a light-emitting gas and one mechanism ionizes and breaks down the gas, and another mechanism runs the lamp with the gas emitting light. The ionizing mechanism may be a pair of conductive ionizers disposed inside of a bulb of the lamp and the running mechanism may be a pair of conductive electrodes disposed outside of the bulb. In response to the gas breaking down, the conductive ionizers may be disconnected from power to avoid significant current flow through conductors internal to the bulb. The electrodes run the lamp with a low current flow.

Figure 1:
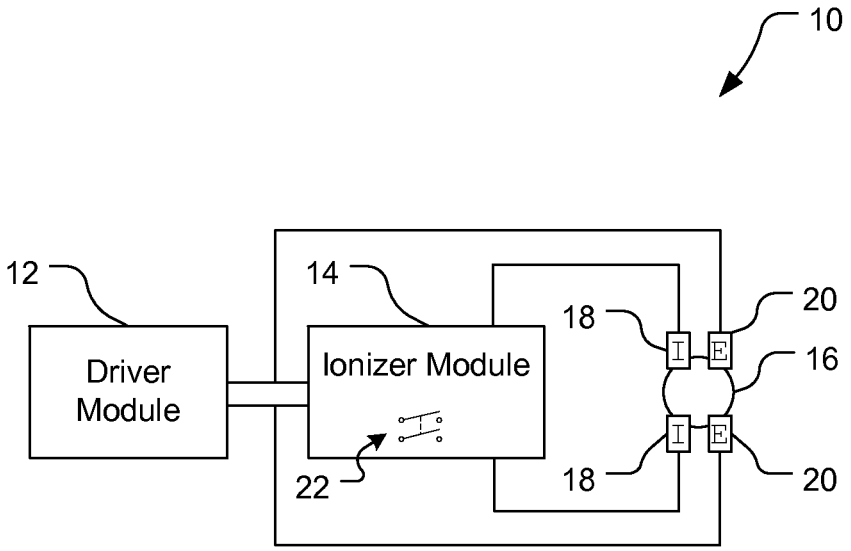
FIG. 1 is a block diagram of an electrical discharge lighting system.

Referring to FIG. 1, an electrical discharge lighting system 10 includes a driver module 12, an ionizer module 14, and a lamp 16 that includes ionizers 18 and electrodes 20. The modules 12, 14 together comprise a power supply that is configured to receive power from a power source and that is electrically coupled to the ionizers 18 and electrically coupled to the electrodes 20 and configured to provide a strike voltage to the ionizers 18 and to provide a drive power to the electrodes 20. The ionizers 18 are configured to receive the strike voltage from the power supply and to provide the strike voltage to a gas contained by the lamp 16. The modules 12, 14 are electrical circuits (e.g., solid-state circuitry) configured to operate the lamp 16. The circuitry for the modules 12, 14 can be simple, easy and cheap to produce, and small. The driver module 12 and/or the ionizer module 14 may be disposed on a printed circuit board (PCB), and the PCB may contain further circuitry, e.g., for functionality in addition to that described herein. Alternatively, some or all of the driver module 12 may be disposed on a flex board. Further, the driver module and the ionizer module 14 may be integrated into a single integrated circuit chip.

The system 10 includes separate mechanisms for starting and running the lamp 16. The driver module 12 provides drive power to the ionizer module 14 and to the electrodes 20. The ionizer module 14 is configured to receive and convert a drive voltage of the driver module 12 to a strike voltage and to provide the strike voltage to the ionizers 18. The ionizer module 14 is configured to provide the strike voltage to the ionizers 18 until a threshold voltage between the ionizers is reached, and then to shut off to isolate the strike voltage from the ionizers 18. The ionizers 18 are configured to receive the strike voltage from the power supply, specifically the ionizer module 14, and to convey the strike voltage to a light-emitting gas (e.g., a gas mixture) in the lamp 16 to ionize and break down the gas to strike (start) the lamp 16. The electrodes 20 are configured to receive the drive power from the power supply and to convey the drive power to the gas in the lamp 16. After the lamp 16 is started, the drive power from the power supply will run the lamp 16.

The ionizer module 14 is configured to provide a strike voltage to the ionizers 18 using a voltage provided by the driver module 12. The ionizer module 14 may be configured to drive the ionizers 18 with alternating-current (AC) power or may be configured to drive the ionizers 18 with direct-current (DC) power. For example, the ionizer module may be configured to provide about 30,000 VDC or about 30,000 VAC peak to the ionizers 18. To drive the ionizers 18 with AC power, the ionizer module 14 could comprise a transformer to increase the voltage from the driver module 12 to a strike voltage to ionize and break down a light-emitting gas in the lamp 16.

The ionizer module 14 is configured to stop or nearly stop the ionizers 18 from conducting electricity during running of the lamp 16. Thus, the ionizer module 14 effectively acts as a double pole, single throw switch 22 responsive to a voltage level across the gas in the lamp 16. The switch 22 is configured to respond to voltage across the ionizers 18 exceeding a threshold by shutting off. That is, the switch is 22 configured to respond to the gas breaking down, which results in an effective short in the lamp 16 and voltage across the ionizers 18 increasing, by discontinuing to provide power from the driver module 12 to the ionizers 18 such that the ionizers 18 will have little or no current flowing through them. The ionizers 18 and the electrodes 20 are powered in parallel, from the driver module 12 and the ionizer module 14, respectively, so that power can be provided to the electrodes 20 while power is inhibited from reaching the ionizers 18.

Figure 2:
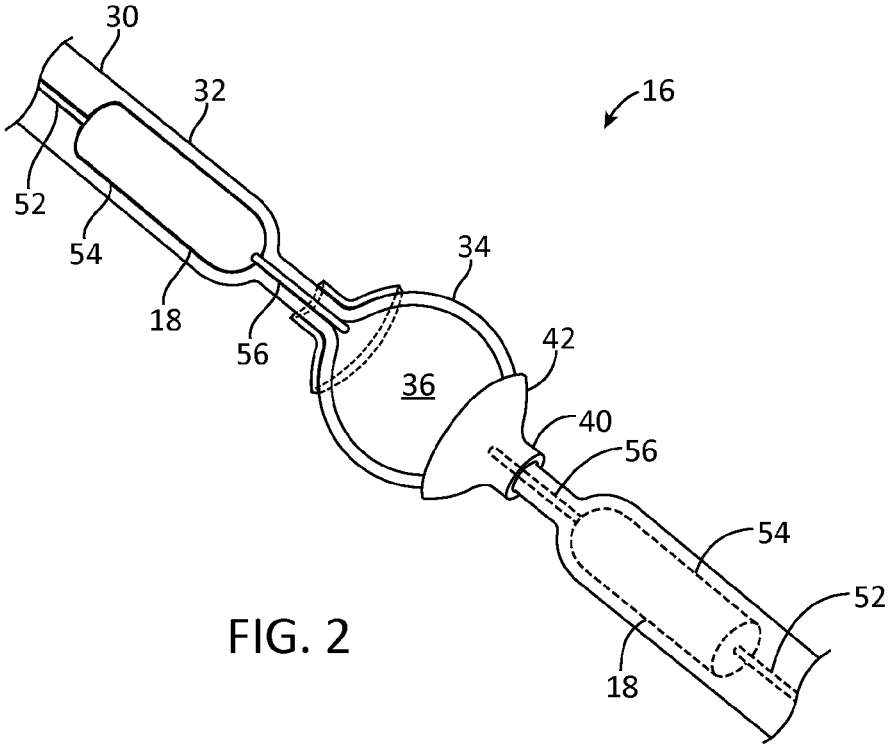
FIG. 2 is a partially-cut-away perspective view of an example lamp for use in the system shown in FIG. 1.
Figure 3:
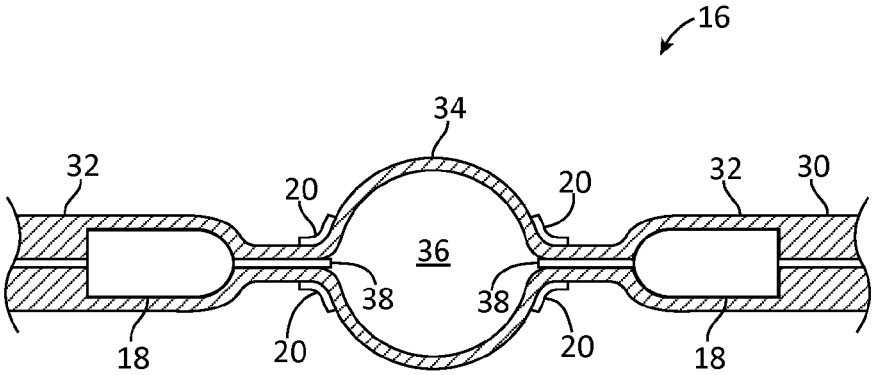
FIG. 3 is a cross-sectional view of the lamp shown in FIG. 1.

Referring also to FIGS. 2-3, the lamp 16 is an electrical discharge lamp and includes a bulb 30, the ionizers 18, and the electrodes 20. The lamp 16 has few parts, helping the lamp 16 to be easy and inexpensive to manufacture, and highly reliable. The lamp 16 can be made without use of hazardous materials such as mercury. The bulb 30 includes receptacles 32 that house the ionizers 18 and a chamber section 34 that defines a chamber 36 in which the light-emitting gas is contained. To facilitate understanding and to simplify the figures, only the bulb 30 is shown with cross-hatching, and only then in FIG. 3.

The bulb 30 may be of various sizes, shapes, and/or materials. Consequently, the bulb 30 lends the lamp 16 to a wide variety of applications, e.g., commercial (including hospital/medical), residential, portable lights (e.g., flashlights), etc. The bulb 30 may comprise any of a variety of materials (e.g., quartz) or any of a variety of combinations of materials. The particular material or materials used may depend upon the desired characteristics of the bulb 30 based on the application for the system 10. The chamber section 34 may have any of various sizes (e.g., that may be selected based upon the wattage desired of the lamp 16) and/or shapes. Here, the chamber section 34 is substantially spherical, i.e., has radius that is constant +/−10%. The chamber section 34 is an incomplete sphere due to transitions to the receptacles 32. In the example shown in FIGS. 2-3, the receptacles 32 are tubes and the chamber section 34 is substantially spherical. The lamp 16 may be configured according to a variety of standard (existing) or emerging lamp configurations of size, shape, and or base or housing configurations. For example, the lamp 16 may be mated with a base that can be inserted into a standard (e.g., Edison) light socket.

The light-emitting gas is configured to respond to the application of a voltage to ionize, break down, and conduct electricity and to emit light in response to conducting the electricity. The light-emitting gas may be any of a variety of gases or any of a variety of combinations of gases (e.g., metal halide plasma). The particular gas or gases used as the light-emitting gas may be based on desired characteristics of the system such as a color rendering index, a shape of the chamber section 34, a size of the chamber section 34, cooling characteristics of the bulb 30, etc.

Further, numerous physical arrangements of the lamp 16 may be used. FIGS. 2-3 show an example with the receptacles 32 being collinear, i.e., disposed along a common axis, and connected to the chamber section 34 at opposite ends of a length of the chamber section 34, but this is only one example and not exhaustive. For example, the receptacles 32 could be parallel to each other or at some other relationship to each other. Further, the receptacles could connect to the chamber section 34 across a width of the chamber section 34, or at points less than 180° separated from each other, etc.

The ionizers 18, for starting the lamp 16, and the electrodes 20, for running the lamp 16, are distinct, and thus distinct apparatus are used for lamp start-up and lamp run. The ionizers 18 and the electrodes 20 are physically separate apparatus although they may be driven by a common apparatus. Alternatively, the ionizers 18 may be powered by an ionizer driver and the electrodes powered by an electrode driver, with the ionizer driver and the electrode driver sharing no components, or with the ionizer driver and the electrode driver sharing some but not all components.

Although for simplicity the ionizers 18 and the electrodes 20 are schematically shown similarly in FIG. 1, the ionizers 18 are internal to the bulb 30 while the electrodes 20 are external to the bulb 30 as shown in FIGS. 2-3. The ionizers 18 are disposed inside the bulb 30, and extend toward the chamber 36. The ionizers 18 are coupled to input conductors 52 and include bodies 54, and ionizing conductors 56. The input conductors 52 and the ionizing conductors 56 are in intimate contact with the receptacles 32. The ionizing bodies 54 are configured to form an air-tight seal with the receptacles 32 to retain the gas in the chamber 36. For example, the ionizing bodies 54 may be pieces of foil tightly physically connected to interior surfaces of the receptacles 32 (e.g., with the bulb 30 heated and shrunk to fit against the bodies 54) to form hermetic seals with the receptacles 32. The ionizing conductors 56 can be small (e.g., 0.0001 in. in diameter), e.g., because the ionizing conductors 56 will not conduct significant amounts of current. Ends 38 of the ionizers 18 are preferably in physical contact with the gas in the chamber 36 but may be isolated from the chamber 36, preferably being disposed at a transition between the receptacles 32 and the chamber 36 as shown in FIG. 3, although one or both of the ends 38 may alternatively be disposed in the chamber 36. If either of the ends 38 is disposed in the chamber 36, i.e., either of the ionizing conductors 56 extends into the chamber 36, then such ionizing conductor 56 preferably extends into the chamber 36 less than 10% of a width of the chamber 36, here a distance between the receptacles 32 across the chamber 36. For example, the ionizing conductors 56 may extend into the chamber 36 about 0.5 mm with the width of the chamber being about 7 mm. With the ionizers 18 extending very little if at all into the chamber 36, the likelihood of any ionizer splatter (i.e., bits of the ionizers breaking off) attaching to the inner surface of the chamber section 34 is kept low. Thus, the likelihood of any splatter affecting the light characteristics of the bulb 30 is low. Further, as little or no current is passed through the ionizers 18, little or no ionizer splatter will occur. The ionizers 18 are made of conductive material, such as tungsten, although other materials or combinations of materials may be used.

Figure 9:
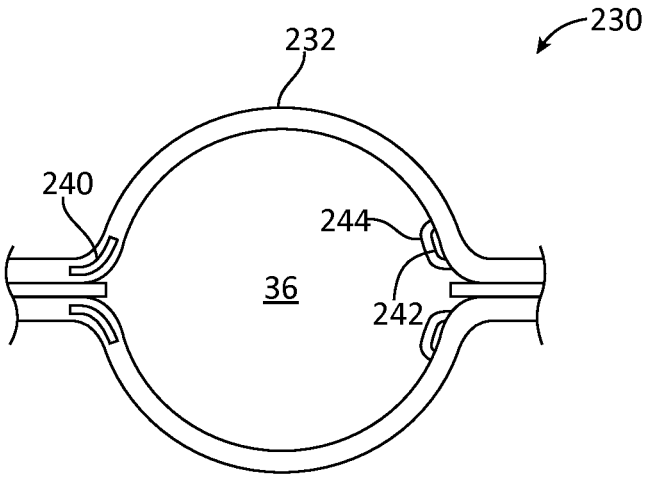
FIGS. 9-11 are cross-sectional views of example lamps.

The electrodes 20 are physically separated from the light-emitting gas, here being external to the bulb 30. As shown in FIGS. 2-3, the electrodes 20 are disposed on portions of an outer surface of the receptacles and portions of an outer surface of the chamber section 34. Alternatively, the electrodes 20 could be disposed within the material of the receptacles 32 and/or the chamber section 34 (see FIG. 9 and associated discussion below). Alternatively still, the electrodes 20 could be part of the receptacles 32 and/or the chamber section 34, e.g., being conductive glass (or other bulb material), conductive material within or on top of glass (or other bulb material), etc. (see FIG. 10 and associated discussion below). Further, combinations of these options may be used (e.g., one electrode being external to the bulb 30 and one electrode being part of the chamber section 34, an electrode being partially external to the bulb 30 and partially within the bulb material, an electrode being partially an external conductor and partially part of the bulb 30, etc.). Because in this example the receptacles 32 are cylindrical tubes and the chamber section 34 is roughly spherical, the electrodes 20 are cup-shaped, with a cylindrical base 40 and a flared section 42 that conforms to the shape of the portion of the chamber section 34 that the flared section 42 overlays. In this example, the electrodes 20 are in direct contact with the receptacles 32 and the chamber 34, but other configurations are possible with one or more of the electrodes not in direct contact with the corresponding receptacle and/or the chamber section 34.

Different configurations and/or quantities of electrodes 20 may be used. For example, the electrodes 20 may be made of any of a variety of conductive materials or any of a variety of combinations of conductive materials. The electrodes 20 may be made in any of a variety of ways, e.g., be conductive coatings on the bulb 30, or be plates of conductive material that are bent to conform to the shape of the bulb 30, etc. The electrodes 20 may have any of a variety of thicknesses. Further, the electrodes 20 may be disposed over only the receptacles 32 or over only the chamber section 34, or within the material comprising the receptacles 32, or within the material comprising the chamber section 34, or combinations of these. The shapes of the electrodes 20 may be different than those shown, and may be different for different electrodes 20. For example, while the electrodes 20 are shown in FIG. 2 as being angularly symmetrical about a longitudinal axis (along which the ionizers 18 extend) of the lamp 16, asymmetrical configurations of the electrodes 20 may be used. Further, while two electrodes 20 are shown in FIGS. 1-3, other quantities of electrodes 20 may be used, e.g., one, three, four, etc. The quantities of electrodes 20 need not be equal on both sides of the chamber section 34. With multiple electrodes 20 used on either side of the chamber section 34, the electrodes 20 may be displaced along the length of the bulb 30, may be displaced angularly around the bulb 30 (e.g., with each electrode extending partially around the bulb 30), or may have any of a variety of other configurations.

The electrodes 20 are capacitively and/or inductively coupled to the gas in the chamber 36. The electrodes 20 are physically separated from the gas by the bulb 30. The electrodes 20 are configured to induce a current through the bulb 30 to induce the gas to produce light.

Figure 4:
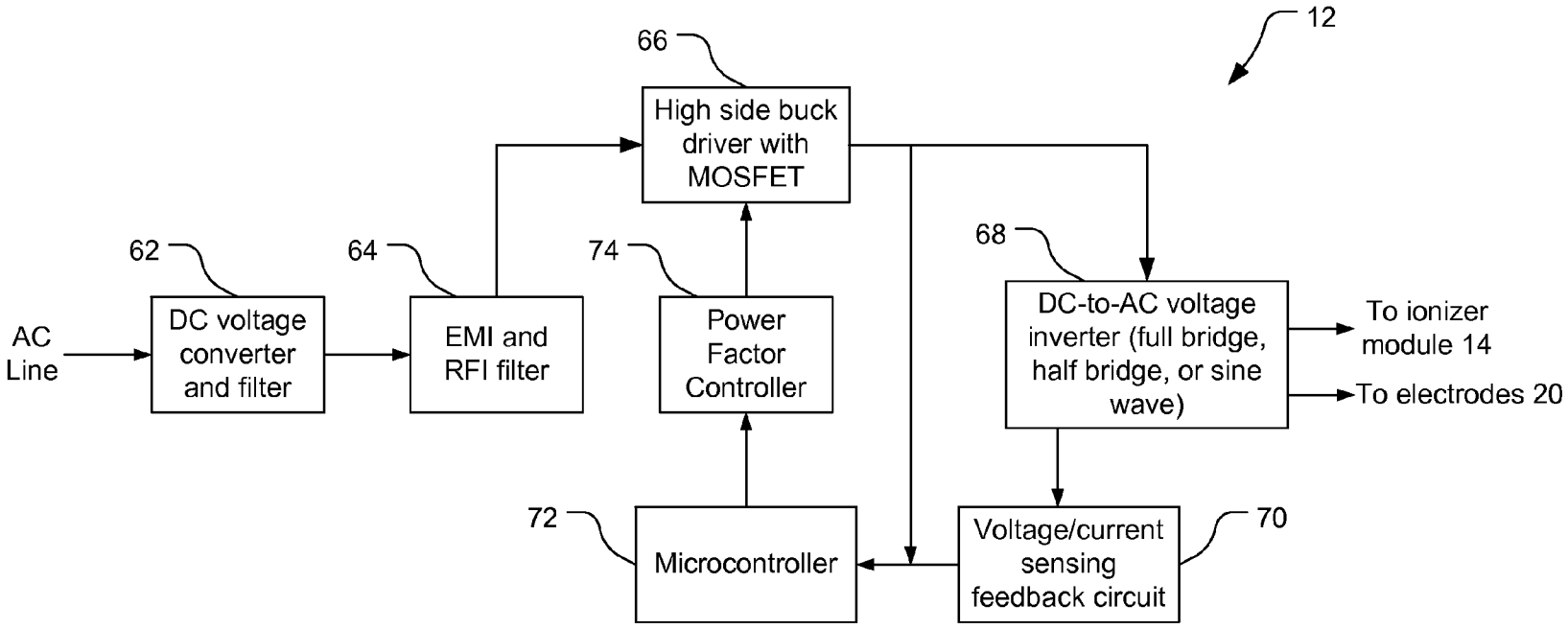
FIG. 4 is a block diagram of driver module shown in FIG. 1.

Referring to FIG. 4, with further reference to FIG. 1, the driver module 12 includes a DC voltage converter and filter 62, an EMI and RFI filter 64, a high-side buck driver with MOSFET 66, a DC-to-AC voltage inverter 68, a voltage/current sensing feedback circuit 70, a microcontroller 72, and a power factor controller 74. The configuration of the driver module 12 shown in FIG. 4 is an example, and numerous other configurations may be used. The driver module 12 is configured to use AC power received from an AC line to provide power in parallel to the ionizers 18 and the electrodes 20.

The DC voltage converter and filter 62 and the EMI and RFI filter 64 are configured to convert the incoming power and inhibit undesired emissions. The DC voltage converter and filter 62 is a configured to convert (rectify) the incoming AC power to DC power and to filter the voltage, e.g., with capacitive filtering. The converter and filter 62 may be configured as a voltage doubler. The EMI (electromagnetic interference) and RFI (radio frequency interference) filter 64 provides a low-pass filter to pass low-frequency signals while inhibiting high-frequency signals (e.g., frequencies above a fundamental running frequency of the system 10) such that high-frequency signals from the DC voltage converter and filter 62 will be blocked from passing to the remainder of the driver module 12 or vice versa.

The high-side buck driver with MOSFET (metal-oxide-semiconductor field-effect transistor) 66 is configured to adjust the power provided by the EMI and RFI filter 64. The buck driver 66 is configured to adjust the voltage and current provided to the DC-to-AC voltage inverter 68 based on one or more indications from the power factor controller 74 such that the ionizers 18 and/or the electrodes 20 receive desirable power.

The inverter 68 is configured to convert the DC voltage from the buck driver 66 to an AC voltage. The inverter 68 may be, for example, a half-bride inverter or a full-bridge inverter, and may provide a variety of output signal shapes such as a square wave output, a modified square wave output, or a sine wave output. The inverter 68 is configured to convert the voltage from the buck driver 66 to an AC voltage and to provide the AC voltage to the ionizer module 14 and to the electrodes 20. For example, the inverter 68 may provide 300 V peak output voltage (i.e., a 300 VAC peak output signal) with the buck driver providing 300 VDC (i.e., a 300 VDC signal). The voltage inverter 68 can produce the AC voltage with any of a wide range of frequencies, e.g., from about 110 Hz to about 2 MHz, or others. The voltage inverter 68 is further configured to use feedback to adjust the AC voltage from the voltage inverter 68 to avoid driving the electrodes 20 in a frequency region of poor acoustical behavior of the lamp 16.

The voltage/current sensing feedback circuit 70 senses the voltage and current provided by the buck driver 66 to the voltage inverter 68 and the voltage and current provided by the voltage inverter 68 to the electrodes 20. The feedback circuit 70 is configured to provide indications of these voltages and currents to the microcontroller 72.

The microcontroller 72 is configured to determine a technique or scheme to be implemented by the power factor controller 74 to implement a desired for the power provided by the buck driver 66 for driving the lamp 16. The microcontroller 72 determines a status of the lamp 16 and indicates an appropriate technique or scheme to the power factor controller 74. For example, the microcontroller uses the voltage provided by the buck driver 66 and the voltages and currents provided by the voltage inverter 68 to determine whether the lamp 16 is hot or cold (e.g., based on whether the lamp 16 is conducting current, based on an amount of time since the lamp 16 ceased conducting current, etc.). The microcontroller 72 sends one or more command signals to the power factor controller 74 to indicate the appropriate technique or scheme to be implemented (e.g., to strike or re-strike the lamp 16). The power factor controller responds to the one or more command signals by sending one or more corresponding control signals to the buck driver 66 to regulate switching of a high-side of a MOSFET such that the buck driver 66 will implement the technique or scheme indicated by the microcontroller 72 and provide power with desired voltage and current to the voltage inverter 68.

Figure 5:
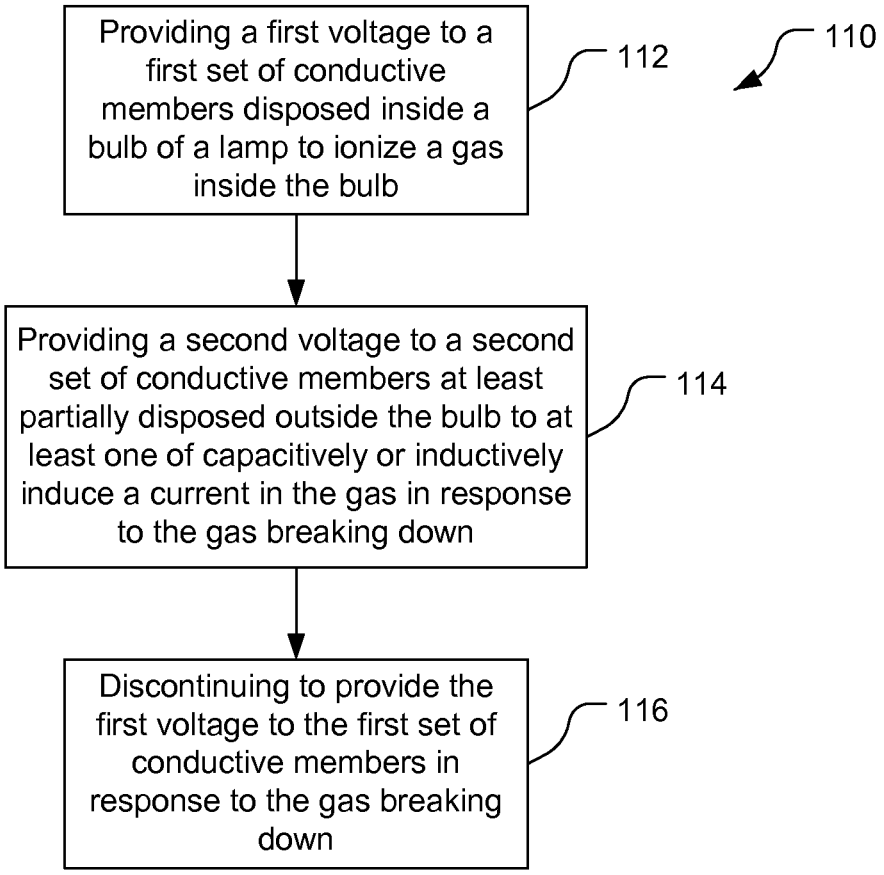
FIGS. 5-6 are block flow diagrams of processes of operating an electrical discharge lighting system.

Referring to FIG. 5, with further reference to FIGS. 1-3, a process 110 of operating an electric-discharge lamp includes the stages shown. The process 110 is, however, an example only and not limiting. The process 110 can be altered, e.g., by having stages added, removed, rearranged, combined, and/or performed concurrently. The process 110 is discussed below for the example of operating the lamp 16 of the system 10.

At stage 112, the process 110 includes providing a first voltage to a first set of conductive members disposed inside a bulb of the lamp to ionize a gas inside the bulb. The ionizer module 14 provides a voltage to the ionizers 18. The voltage across the ionizers will rapidly increase until the gas in the bulb 30 ionizes and breaks down, and thus conducts ignites and conducts electricity.

At stage 114, the process 110 includes providing a second voltage to a second set of conductive members at least partially disposed outside the bulb to capacitively and/or inductively induce a current in the gas in response to the gas breaking down. The driver module 12 provides a voltage to the electrodes 20 in parallel with the voltage provided to the ionizers 18. The voltage applied to the electrodes 20 capacitively induces a voltage across the gas in the chamber 36. The voltage is preferably provided to the electrodes 20 before the gas breaks down, although the driver module could be configured to respond to the gas breaking down to provide the voltage to the electrodes 20. In response to the gas breaking down and becoming conductive, the voltage applied to the electrodes 20 will induce a current through the gas in the chamber 36, which will induce the gas to emit light.

At stage 116, the process 110 includes discontinuing to provide the first voltage to the first set of conductive members in response to the gas breaking down. In response to the gas breaking down and becoming conductive, the voltage applied to the ionizers 18 will induce a quickly-increasing current (a current spike) between the ionizers 18 through the gas in the chamber 36. The ionizer module 14, specifically the switch 22, responds to the current becoming undesirably high (e.g., equal to a current threshold or greater than or equal to the current threshold) by shutting off (e.g., becoming non-conductive) to inhibit, and possibly prohibit, power from the driver module 12 from being delivered to the ionizers 18. The current through the ionizers 18 will drop to zero, or nearly zero in response to the switch 22 turning off.

Figure 6:
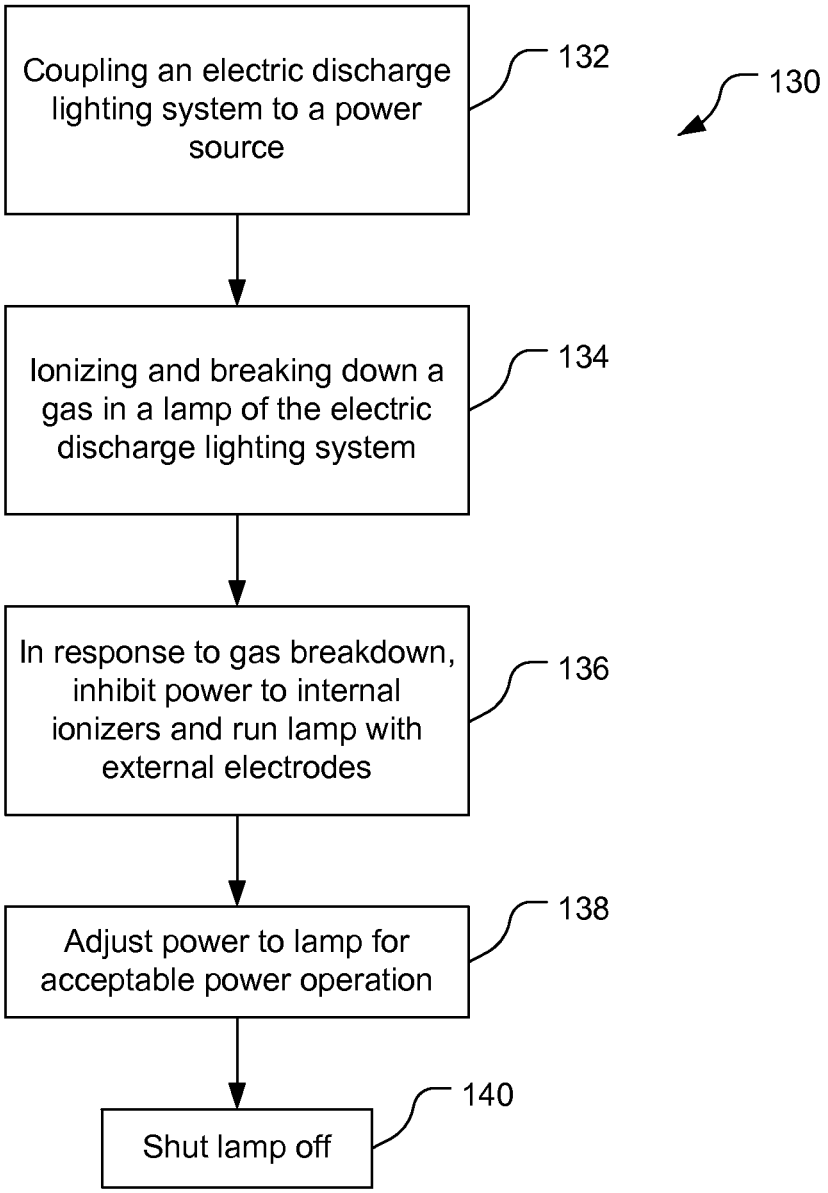

Referring to FIG. 6, with further reference to FIGS. 1-4, a process 130 of operating an electric-discharge lamp includes the stages shown. The process 130 is, however, an example only and not limiting. The process 130 can be altered, e.g., by having stages added, removed, rearranged, combined, and/or performed concurrently. The process 130 is discussed below for the example of operating the lamp 16 of the system 10.

At stage 132, the process 130 includes coupling the electric discharge lighting system 10 to a power source. The DC voltage converter and filter 62 is connected to the AC line, e.g., by plugging in a socket, or toggling a wall-mounted light switch.

At stage 134, the process 130 includes ionizing and breaking down the gas in the lamp 16. The power from the AC line is converted to DC power and filtered by the DC voltage converter and filter 62, and filtered further by the EMI and RFI filter 64. The buck driver 66 steps down the voltage from the filter 64 and provides the stepped-down voltage to the voltage inverter 68. The voltage inverter 68 converts the voltage from the buck driver 66 to an AC voltage, e.g., about 300 VAC peak. This voltage is provided to the electrodes 20 and to the ionizer driver 14. The ionizer driver 14 increases this voltage, e.g., to about 30,000 VAC peak, and provides the increased voltage to the ionizers 18. The voltage applied to the ionizers 18 causes the voltage across the gas in the chamber 36 to increase rapidly, eventually ionizing and breaking down. The speed at which this happens is a function of the configuration of the lamp 16, e.g., the particular gas in the chamber 36, the configuration of the ionizers, and/or the voltage applied to the ionizers, and may be on the order of microseconds. For example, the gas may break down at about 8,000 VAC peak if the gas is cold (e.g., room temperature) or about 22,000-25,000 VAC peak if the gas is hot (e.g., if the lamp 16 has been running for several minutes or more and has just been turned off), or between about 8,000 VAC peak and about 25,000 VAC peak for intermediate gas temperatures.

At stage 136, in response to the gas breaking down, the voltage to the ionizers 18 is stopped and the electrodes induce current flow through the gas to run the lamp 16. As discussed above with respect to stage 116 of FIG. 5, when the gas breaks down, the ionizer module 14 stops providing power to the ionizers 18 so that little or no current flows through the ionizers 18. Further, the voltage from the voltage inverter 68 provided to the electrodes 20 drops due to the change in resistance of the gas. For example, the 300 VAC peak voltage may drop to about 20 VAC peak. The voltage from the voltage inverter 68 provides a voltage across the gas due to the capacitive and/or inductive coupling of the voltage from the electrodes 20 into the gas. This voltage from the electrodes induces a current across the gas, which in turn produces light. For example, the current will typically be less than 1.5 amps for a 15 watt lamp. With little or no current through the ionizers 18, and low current through the electrodes 20, the lamp 16 operates with low losses.

At stage 138, the power to the lamp 16 is adjusted for acceptable power operation. With the lamp 16 running, and current flowing through the gas, the gas heats up. As the gas temperature increases, the impedance of the gas increases, and consequently the voltage across the gas increases. The increase in voltage is monitored by the feedback circuit 70 and reported to the microcontroller 72 that will change to a power mode to attempt to maintain the total power to the lamp 16 at a desired, stable power level. The microcontroller 72 uses the voltage provided by the buck driver 66 and the voltages and currents provided by the voltage inverter 68 to determine adjustments to the voltage and current provided by the buck driver 66 to have the lamp 16 power remain within an acceptable range of power. The microcontroller 72 sends one or more command signals to the power factor controller 74 that responds by sending one or more control signals to the buck driver 66 to control switching of the buck driver 66 such that the buck driver 66 provides a voltage that will induce the voltage inverter to provide a voltage and current such that the lamp 16 power is within the acceptable range (e.g., 15 W +/−0.5 W, 20 W +/−1 W, etc.).

At stage 140, the lamp 16 is shut off. The DC voltage converter and filter 62 may disconnected from the AC line to prevent power from flowing through the driver module 12 toward the lamp 16. Alternatively, the microcontroller 72 can cause a shutoff of power from reaching the lamp 16. For example, the microcontroller 72 can respond to the voltage across the lamp 16 returning to the voltage of the voltage inverter 68 before breakdown of the gas (e.g., to about 300 VAC) by causing the power factor controller 74 to cause the buck driver to stop switching so that the buck driver 66 does not provide voltage to the voltage inverter 68.

After shutoff, the lamp 16 can be restarted. The process 130 can be started anew. The restarting (re-striking) of the lamp 16 may be done any time after shutoff of the lamp 16, including immediately after shutoff, as long as the voltage initially provided by the ionizer module is higher than the breakdown voltage of the gas at shutoff. For example, if the highest breakdown voltage of the gas is about 25,000 V (with the gas at its hottest due to running, e.g., 3,000 K or higher) and the driver module 12 and the ionizer module 14 are configured to provide 30,000 V to the ionizers 18, then the lamp 16 can be restarted (restruck) immediately after being shut off.

EXAMPLE

Figure 7:
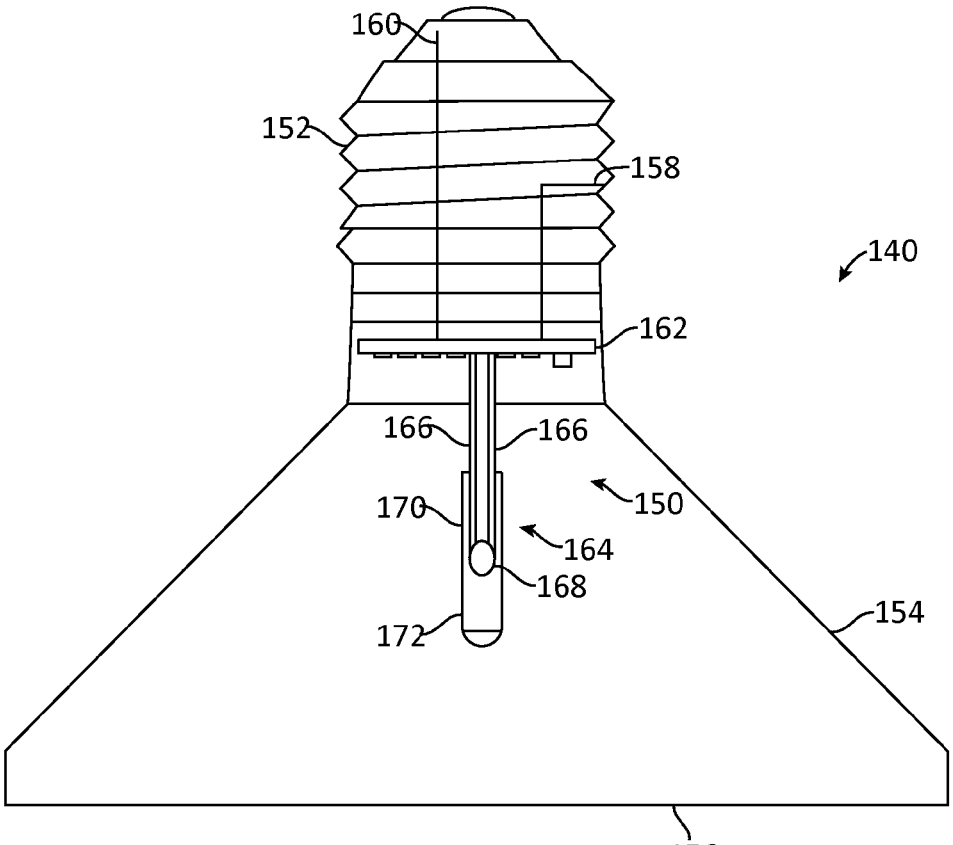
FIG. 7 is a plan view of a light using an electrical discharge lighting system.

Numerous configurations in accordance with the discussion above are possible, e.g., to be used with or that are compatible with a variety of light types and applications. Referring to FIG. 7, with further reference to FIG. 1, an example of a light 140 includes an electrical discharge lighting system 150, a standard base 152, a housing/reflector 154, and a cover 156. The base 152 is configured to fit into a household light socket. A neutral wire 158 and a hot wire 160 are connected to a PCB 162 containing the driver module 12 and the ionizer module 14. A lamp 164 extends away from the PCB 162, with receptacles 166 being parallel to each other and connected to a chamber section 168 of a bulb 170 of the lamp 164 at about opposite ends of a width of the chamber section 168. The bulb 170 includes an endcap 172 that covers and protects the chamber section 168, and is transparent to allow the light emitted from gas in the chamber section 168 to pass out of the lamp 164. The housing/reflector 154 is configured to receive light emitted to the sides of the lamp 164 and to reflect light out through the cover 156. The cover 156 is made of a transparent, durable material to protect the lamp 164.

Other Considerations

While the discussion above focused on electrodes for driving a lamp being disposed outside of a lamp bulb, one or more of the electrodes could be disposed inside the bulb, but preferably physically separated from (i.e., not in direct physical contact with) the light-emitting gas in the bulb. For example, the internal electrode(s) could be disposed inside a glass or plastic member (e.g., a coating or covering).

Figure 8:
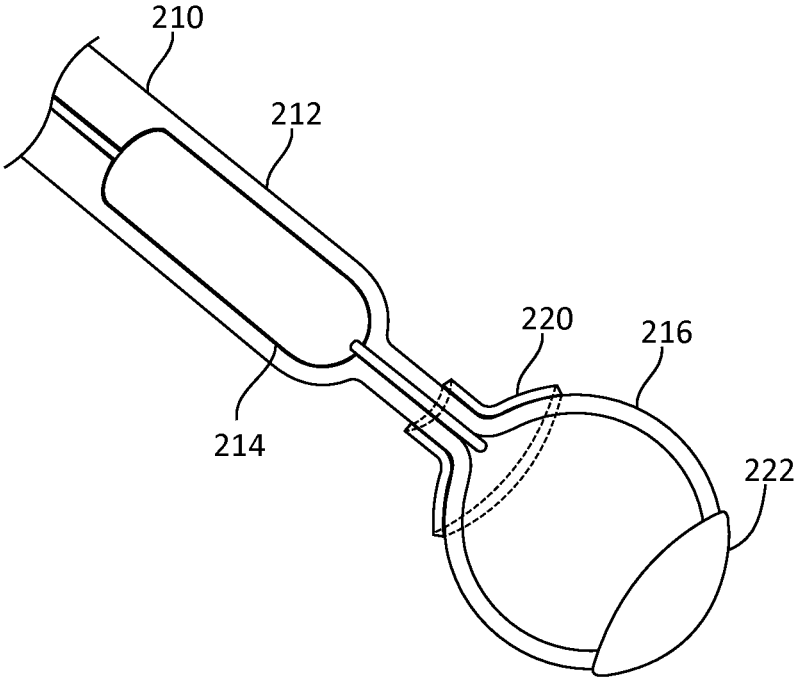
FIG. 8 is a partially-cut-away perspective view of another example lamp.

Further, the discussion above focused on the use of two ionizers. Different quantities of ionizers could be used. For example, a single ionizer could be used that couples with at least one run-time electrode (e.g., at least one of the electrodes 20). Thus, for example, as shown in FIG. 8, a bulb 210 could be used that is similar to the bulb 30 shown in FIG. 2 but with one of the receptacles 32, and the corresponding ionizer 18, removed. The bulb 210 includes a single receptacle 212 and a single ionizer 214. A chamber section 216 of the bulb 210 is contiguous (i.e., with no gaps between portions of the chamber section 216) away from a transition to the receptacle 212. A first electrode 220 is similar to one of the electrodes 20 shown in FIG. 2, while a second electrode 222 is cup shaped or bowl shaped. Other shapes may be used for the first electrode 220 and/or the second electrode 222 (e.g., shapes with rings, spokes, or other gaps between portions of the electrode, or other shapes without gaps such as a square, a triangle, etc.).

Figure 10:
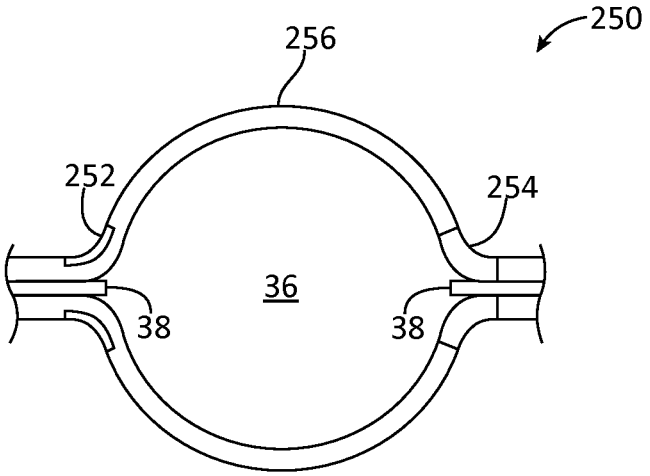

Further still, the discussion above focused on implementations with the use of electrodes that are external to the bulb. In other implementations, the electrodes may be wholly or partially within a perimeter of the bulb. For example, referring to FIG. 9, a lamp 230 includes a bulb 232, an electrode 240, and an electrode 242. The electrode 240 is shaped similar to the electrodes 20 shown in FIGS. 2-3 but is disposed within the material of the bulb 232. A connector (not shown), such as a wire, connects the electrode 240 to receive power. The electrode 242 is disposed on an inner surface of the bulb 232 (here on an inner surface of a chamber section of the bulb 232). The electrode 242 is separated from the gas in the chamber section by a coating 244 (which may alternatively also lie between the electrode 242 and the inner surface of the chamber section). Further, an electrode may be wholly or partially part of a bulb. Referring to FIG. 10, a lamp 250 includes a bulb 256, an electrode 252, and an electrode 254. The electrodes 252, 254 are portions of the bulb 256, e.g., being conductive regions of the bulb 256. For example, the electrodes 252, 254 may be portions of the bulb 256 that have been impregnated with conductive material. Also, the electrodes 252, 254 may be of various shapes and/or extend to various depths within the bulb material. For example, an electrode that is part of a bulb may be very shallow and disposed only near an exterior surface of the bulb material, or shallow and disposed only near an interior surface of the bulb material, etc. Further, electrodes that are part of the bulb may have non-uniform depths into the bulb material. In the example shown in FIG. 10, the electrode 252 extends slightly into the bulb material from an exterior surface of the bulb 256 while the electrode 254 extends all the way through the bulb material.

Figure 11:
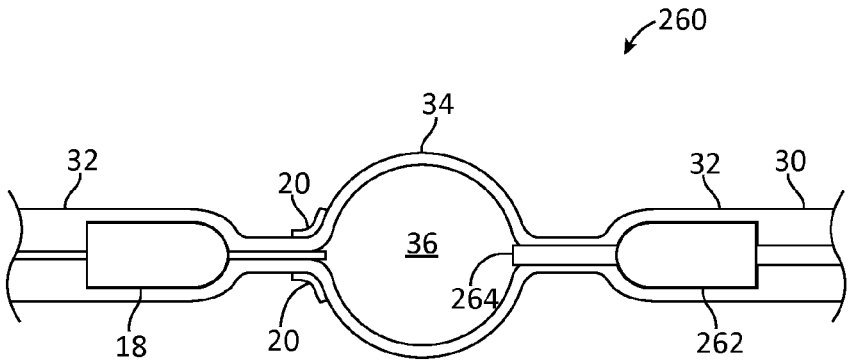

Further still, the discussion above focused on implementations using multiple electrodes distinct from (i.e., independent of) any ionizer. In other implementations, a single external electrode may be used that is independent of an ionizer. For example, as shown in FIG. 11, a lamp 260 is similar to the lamp 16 shown in FIG. 3, but one of the electrodes 20 is not present, and one of the ionizers 18 has been replaced with an ionizer 262 that will serve as an ionizer to strike the lamp 260 and as an electrode to run the lamp 260. An end 264 of the ionizer 262 is larger than the end 38 of the ionizer 18 to accommodate for conducting current.

Figure 12:
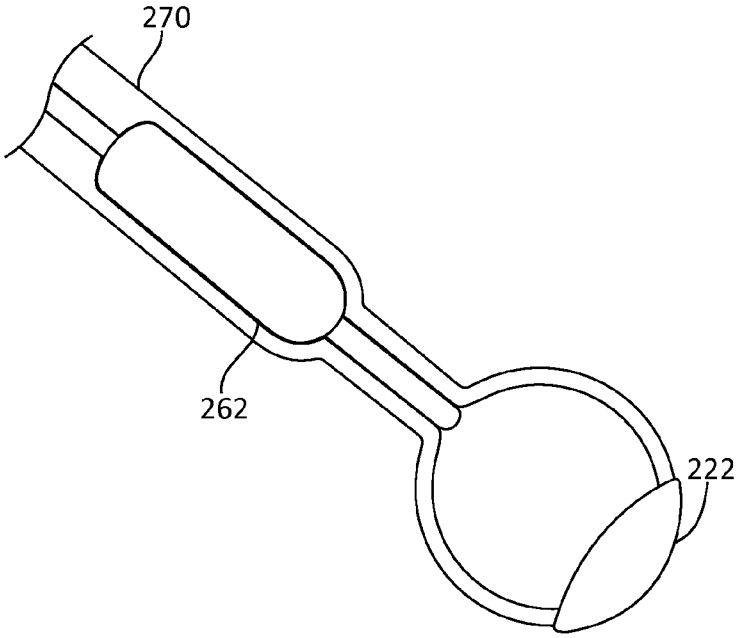
FIG. 12 is a partially-cut-away perspective view of another example lamp.

Also, example configurations of electrodes and example combinations of electrode configurations have been shown, but these are not limiting of the electrode configurations and/or combinations that may be used. Any of the electrode configurations could be used in a lamp, and configurations may be combined (e.g., an electrode may be partially disposed outside a bulb and partially inside the bulb and/or partially part of the bulb). Further, a single lamp may use different electrode configurations (e.g., see FIGS. 9-11). For example, referring to FIG. 12, a lamp 270 includes a single electrode 222 and a single ionizer 262. The ionizer 262 acts as both an ionizer for striking the lamp 270 and an electrode for running the lamp 270. The electrode 222 acts as both an electrode for running the lamp 270 and an ionizer for striking the lamp 270. Using the lamp 270, the ionizer module 14 may be eliminated, and a single voltage provided to the ionizer 262 and the electrode 222.

The same references number may be used in multiple figures to indicate similar, though not necessarily identical, features. For example, while the bulb 30, the receptacles 32, the chamber section 34, and the chamber 36 have the same reference numbers in FIGS. 3 and 11, the configurations of these features are not identical in the two figures.

Other examples and implementations are within the scope and spirit of the disclosure and appended claims. For example, features implementing functions may be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C), or combinations with more than one feature (e.g., AA, AAB, ABBC, etc.).

As used herein, including in the claims, unless otherwise stated, a statement that a function or operation is "based on" an item or condition means that the function or operation is based on the stated item or condition and may be based on one or more items and/or conditions in addition to the stated item or condition.

Substantial variations may be made in accordance with specific requirements. For example, customized hardware might also be used, and/or particular elements might be implemented in hardware, software (including portable software, such as applets, etc.), or both.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Further, more than one invention may be disclosed.

The invention claimed is:

1. An electrical discharge lighting apparatus comprising:
- a bulb including a chamber section comprising transparent material and containing a gas that is responsive to electric current to emit light;
- an ionizing conductor configured and disposed to provide a voltage across the gas to ionize and break down the gas; and
- an electrode:
  - physically separate from the ionizing conductor;
  - with a shape similar to a portion of the chamber section; and
  - configured and disposed to induce a running current through the gas to produce light.

2. The apparatus of claim 1, wherein the electrode is physically isolated from the gas and at least one of capacitively or inductively coupled to the gas to induce the current through the gas.

3. The apparatus of claim 2, wherein the electrode is disposed outside the bulb.

4. The apparatus of claim 2, wherein the electrode is disposed at least partially within a material forming the bulb or is at least partially part of the bulb.

5. The apparatus of claim 1, wherein the electrode is a first electrode, the apparatus further comprising at least a second electrode.

6. The apparatus of claim 5, wherein the bulb comprises a tubular receptacle that receives the ionizing conductor and extends from the chamber section, and wherein the first electrode is disposed over a portion of the receptacle and a first portion of the chamber section, and the second electrode is disposed over a second portion of the chamber section displaced from the first portion of the chamber section.

7. The apparatus of claim 6, wherein the chamber section is substantially spherical.

8. The apparatus of claim 5, wherein the first electrode has a first configuration and the second electrode has a second configuration that is different from the first configuration.

9. The apparatus of claim 1, wherein the ionizing conductor is disposed inside the bulb.

10. The apparatus of claim 9, wherein the ionizing conductor is disposed in physical contact with the gas.

11. The apparatus of claim 1, wherein the ionizing conductor is configured to provide the voltage in conjunction with at least one of the electrodes.

12. The apparatus of claim 1, wherein the ionizing conductor comprises a first ionizing conductor, the apparatus further comprising a second ionizing conductor, wherein the first ionizing conductor is configured to provide the voltage in conjunction with the second ionizing conductor.

13. The apparatus of claim 12, wherein the first ionizing conductor and the second ionizing conductor comprise all the ionizing conductors of the apparatus, wherein the electrode is a first electrode and the apparatus further comprises a second electrode, and wherein the electrode and the second electrode comprise all the electrodes of the apparatus.

14. The apparatus of claim 12, wherein the first ionizing conductor is collinear with the second ionizing conductor.

15. The apparatus of claim 12, wherein the bulb comprises a first receptacle receiving the first ionizing conductor and a second receptacle receiving the second ionizing conductor, and wherein the first receptacle is disposed parallel to the second receptacle.

16. The apparatus of claim 1, further comprising a power supply configured to receive power from a power source and to provide, in parallel, drive power to the electrode and a strike voltage to the ionizing conductor.

17. The apparatus of claim 1, wherein the power supply comprises solid-state circuitry.

18. The apparatus of claim 1, further comprising an ionizer module coupled to the ionizing conductor and configured to:
- receive a strike voltage;
- provide the strike voltage to the ionizing conductor; and
- isolate the strike voltage from the ionizing conductor in response to the ionizing conductor conducting a current in excess of a current threshold.

19. The apparatus of claim 1, wherein the bulb comprises a receptacle receiving the ionizing conductor, the receptacle being connected to the chamber section, wherein the chamber section defines a chamber containing the gas, and wherein the ionizing conductor extends into the chamber less than 10% of a distance across the chamber.

20. The apparatus of claim 1, wherein the electrode conforms to a portion of the chamber section.

21. The apparatus of claim 20 wherein the electrode overlays the portion of the chamber section.

22. The apparatus of claim 20 wherein the electrode is disposed inside the transparent material of the portion of the chamber section.

23. An electrical discharge lighting apparatus comprising:
- a bulb including a chamber section and a receptacle section, the chamber section comprising transparent material and forming a chamber that contains a gas that is responsive to electric current to emit light;
- an ionizing conductor received by the receptacle section and extending into the chamber; and
- an electrode:
  - physically separate from the ionizing conductor;
  - with a shape similar to a portion of the chamber section; and disposed to induce a running current through the gas to produce light.

24. The apparatus of claim 23, wherein the electrode conforms to a shape of the portion of the chamber section.

25. The apparatus of claim 24, wherein the electrode is cup shaped.

26. The apparatus of claim 23, wherein the electrode overlays the portion of the chamber section.

27. The apparatus of claim 23, wherein the electrode is at least partially inside the transparent material of the chamber section.

* * * * *